US010882331B2

(12) United States Patent
Shinoda

(10) Patent No.: US 10,882,331 B2
(45) Date of Patent: Jan. 5, 2021

(54) PRINTING APPARATUS CONTROLLING ENERGY TO BE SUPPLIED TO THERMAL HEAD

(71) Applicant: BROTHER KOGYO KABUSHIKI KAISHA, Nagoya (JP)

(72) Inventor: Noriko Shinoda, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/367,185

(22) Filed: Mar. 27, 2019

(65) Prior Publication Data

US 2019/0351680 A1 Nov. 21, 2019

(30) Foreign Application Priority Data

May 18, 2018 (JP) ..... 2018-096310

(51) Int. Cl.

| | |
|---|---|
| ***B41J 2/355*** | (2006.01) |
| ***B41J 25/312*** | (2006.01) |
| ***B41J 3/407*** | (2006.01) |
| ***B41J 11/00*** | (2006.01) |
| ***B41J 11/04*** | (2006.01) |

(52) U.S. Cl.

CPC ..... *B41J 2/355* (2013.01); *B41J 3/4075* (2013.01); *B41J 11/0025* (2013.01); *B41J 11/0095* (2013.01); *B41J 11/04* (2013.01); *B41J 25/312* (2013.01)

(58) Field of Classification Search

CPC ..... B65H 29/62; B41J 13/0009; B41J 3/0475; B41J 11/02; B41J 11/04; B41J 11/053; B41J 11/057; B41J 11/06; B41J 11/08; B41J 11/10; B41J 11/13; B41J 25/304; B41J 25/308; B41J 25/3082; B41J 25/3084; B41J 25/3086; B41J 25/3088; B41J 25/312; B41J 25/316

See application file for complete search history.

(56) References Cited

U.S. PATENT DOCUMENTS

| | | | | |
|---|---|---|---|---|
| 4,879,566 | A | 11/1989 | Hanabusa | |
| 9,962,975 | B2 * | 5/2018 | Obara | B41J 11/46 |

FOREIGN PATENT DOCUMENTS

| | | | | |
|---|---|---|---|---|
| JP | 1-157869 | A | 6/1989 | |
| JP | 5-338244 | A | 12/1993 | |
| JP | 7-81122 | A | 3/1995 | |
| JP | 2012-16896 | A | 1/2012 | |
| JP | 2012016896 | * | 1/2012 | B41J 2/36 |

* cited by examiner

*Primary Examiner* — Kristal Feggins
(74) *Attorney, Agent, or Firm* — Kenealy Vaidya LLP

(57) ABSTRACT

In a printing apparatus, the thermal head includes a plurality of heater elements arranged in line. A sheet which is conveyed in a conveyance direction is nipped between a platen member and the thermal head. The urging member urges at least one of the thermal head and the platen member to approach each other to generate pressure to the sheet nipped between the thermal head and the platen member. The pressure varies in accordance with a position in a width direction crossing the conveyance direction. The processor sets energy to be supplied to the plurality of heater elements so that the lower pressure a portion of the sheet in the width direction receives, the higher energy is to be supplied to a heater element corresponding to a position of the portion in the width direction. The processor controls the set energy to be supplied to the plurality of heating elements.

19 Claims, 9 Drawing Sheets

FIG. 11

CORRECTION VALUES OF Ton DURATION OF TIME

| TYPE OF MEDIUM | WIDTH [mm] | STB1 1~ 250dot | STB2 251~ 500dot | STB3 501~ 750dot | STB4 751~ 1000dot | STB5 1001~ 1250dot |
|---|---|---|---|---|---|---|
| MEDIUM MA | 100 | 1.1 | 1.05 | 1 | 1 | 1 |
| MEDIUM MA | 50 | | | 1 | 1 | 1.1 |
| MEDIUM MB | 100 | 1.2 | 1.15 | 1.1 | 1.1 | 1 |

FIG. 12

CONVEYANCE SPEED 110mm/sec

| TYPE OF MEDIUM | WIDTH [mm] | HEAD TEMPERATURE | | |
|---|---|---|---|---|
| | | 5℃ | 23℃ | 40℃ |
| MEDIUM MA | 100 | 325μs | 310μs | 280μs |
| MEDIUM MA | 50 | 325μs | 310μs | 280μs |
| MEDIUM MB | 100 | 400μs | 380μs | 360μs |

FIG. 13

HISTORY CONTROL (SUB_ON)

| TYPE OF MEDIUM | WIDTH [mm] | STB1 1~ 250dot | STB2 251~ 500dot | STB3 501~ 750dot | STB4 751~ 1000dot | STB5 1001~ 1250dot |
|---|---|---|---|---|---|---|
| MEDIUM MA | 100 | ON | ON | OFF | OFF | OFF |
| MEDIUM MA | 50 | | | OFF | OFF | ON |
| MEDIUM MB | 100 | ON | ON | OFF | OFF | OFF |

WAVEFORM WITH SUB PULSE ON

WAVEFORM WITH SUB PULSE OFF

PRINTING APPARATUS CONTROLLING ENERGY TO BE SUPPLIED TO THERMAL HEAD

CROSS REFERENCE TO RELATED APPLICATION

This application claims priority from Japanese Patent Application No. 2018-096310 filed May 18, 2018. The entire content of the priority application is incorporated herein by reference.

TECHNICAL FIELD

The present disclosure relates to a printing apparatus that includes a thermal head.

BACKGROUND

In a thermal-transfer printing apparatus using a thermal head, various methods have conventionally been proposed to ensure a print quality for a width direction of a print medium. For example, a conventional thermal recording apparatus includes a thermal head, a recording-energy control circuit, a transfer drum serving as an intermediate transfer medium, and a platen pressed against the intermediate transfer medium with a print medium therebetween. The thermal head is divided into a plurality of record blocks arranged in a width direction of the print medium and pressed against the transfer drum with an ink sheet therebetween. The recording-energy control circuit varies energy supplied to the record block in accordance with a pressing force between the thermal head and the transfer drum. In particular, the recording-energy control circuit sets higher energy to be supplied to a record block having a higher pressing force between the thermal head and the transfer drum.

SUMMARY

When a transfer drum is used, it is useful for achieving a uniform print density that higher energy is supplied to a record block which receives a higher pressing force from the transfer drum. However, in a case where a transfer drum is not used, there has been a problem that a print density increases when higher energy is supplied to a record block receiving a higher pressing force than a pressing force received by another record block, thereby leading to noticeable differences in print density in a width direction of a print medium.

In view of the foregoing, it is an object of the disclosure to provide a printing apparatus capable of ensuring a print quality even when pressures applied to a print medium are varied among positions in the width direction of the print medium.

In order to attain the above and other objects, the disclosure provides a printing apparatus. The printing apparatus includes a thermal head, a platen member, an urging member, and a processor. The thermal head includes a plurality of heater elements arranged in line. The platen member is in confrontation with the thermal head. A sheet which is conveyed in a conveyance direction is nipped between the platen member and the thermal head. The urging member is configured to urge at least one of the thermal head and the platen member to approach each other to generate pressure to the sheet nipped between the thermal head and the platen member. The pressure varies in accordance with a position in a width direction crossing the conveyance direction. The processor is configured to: set energy to be supplied to the plurality of heater elements so that the lower pressure a portion of the sheet in the width direction receives, the higher energy is to be supplied to a heater element corresponding to a position of the portion in the width direction; and control the set energy to be supplied to the plurality of heating elements.

According to another aspect, the disclosure provides a printing apparatus. The printing apparatus includes a thermal head, a platen member, an urging member, and a processor. The thermal head includes a plurality of heater elements arranged in line. The platen member is in confrontation with the thermal head. A sheet which is conveyed in a conveyance direction is nipped between the platen member and the thermal head. An urging member is configured to urge at least one of the thermal head and the platen member to approach each other to generate pressure to the sheet nipped between the thermal head and the platen member. The processor is configured to control energy to be supplied to the plurality of heater elements so that energy supplied to each heater element is depend on a distance from a pressure center to the each heater element, the pressure center being a center of pressure based on urging forces generated by the urging member.

BRIEF DESCRIPTION OF THE DRAWINGS

The particular features and advantages of the disclosure as well as other objects will become apparent from the following description taken in connection with the accompanying drawings, in which:

FIG. 11 is a table illustrating correction values for correcting a Ton duration of time;

FIG. 12 is a table illustrating a relation among a type of medium, a width of medium, a head temperature, and the Ton duration of time during which a heater element generates heat;

FIG. 13 is a table illustrating SUB pulse used in a history control;

FIG. 14 is a waveform when the SUB pulse is ON; and

DETAILED DESCRIPTION

<Overview of Printing Apparatus 1>

Figure 1:
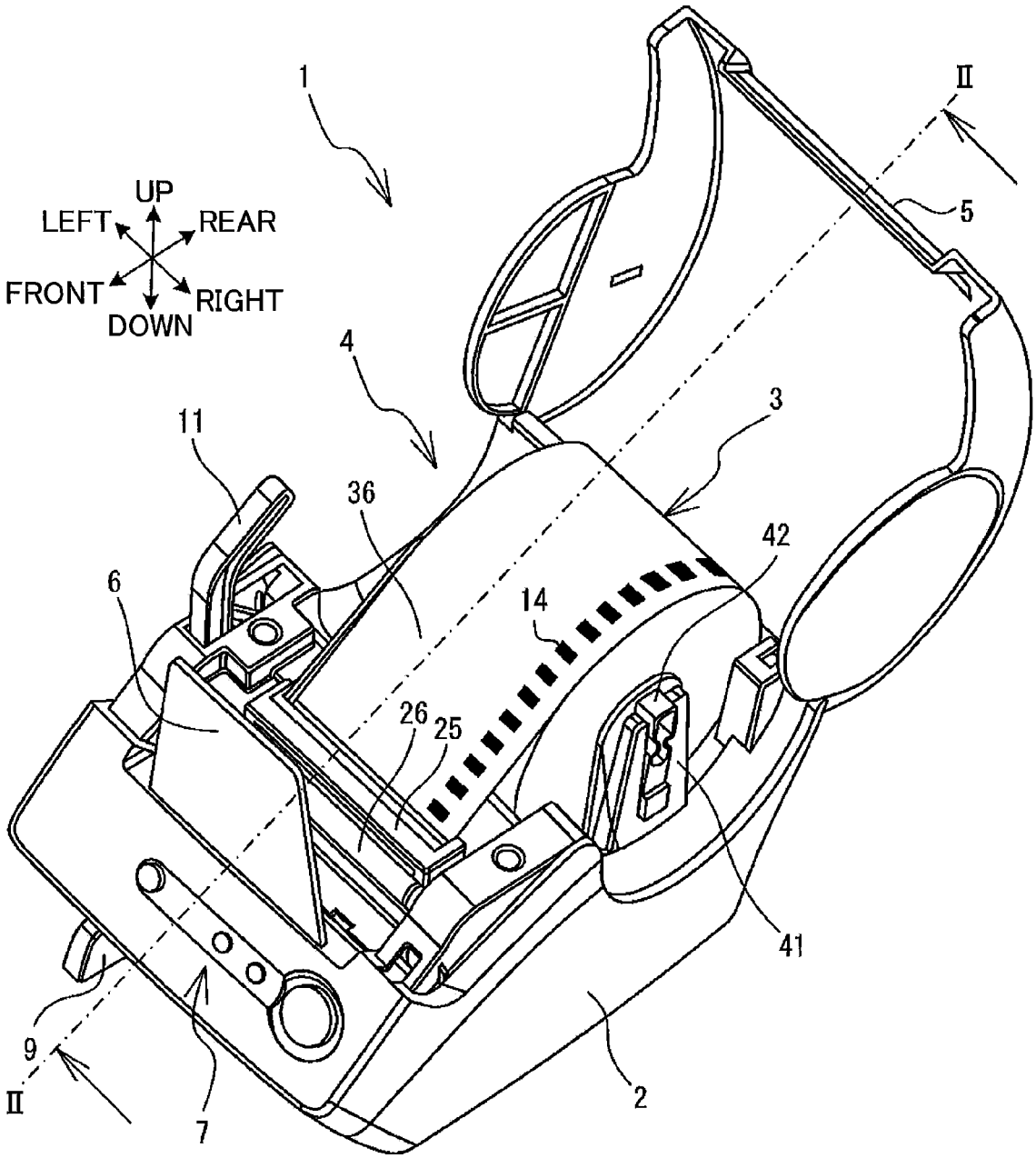
FIG. 1 is a perspective view of a printing apparatus with a cover open according to an embodiment.

A printing apparatus according to an embodiment will be described while referring to the accompanying drawings wherein like parts and components are designated by the same reference numerals to avoid duplicating description. The drawings are for explaining the technical features as an example of the disclosure, and a structure of apparatuses or devices, and flowcharts are not limited to those in the drawings.

The terms "upward", "downward", "upper", "lower", "above", "below", "beneath", "right", "left", "front", "rear" and the like will be used throughout the description assuming that a printing apparatus 1 is disposed in an orientation in which it is intended to be used. In use, the printing apparatus 1 is disposed as shown in FIG. 1. A width direction of a sheet 36 (described hereinafter) is a crossing direction crossing a conveyance direction in which the sheet 36 is conveyed (hereinafter, simply referred to as "conveyance direction"). The crossing direction is a left-right direction. The sheet 36 has a width in the crossing direction.

A printing apparatus 1 will be explained while referring to FIGS. 1 and 2. The printing apparatus 1 can be connected to an external terminal (not illustrated) by a Universal Serial Bus (USB) cable. The external terminal may be, for example, a general-purpose personal computer (PC), a portable terminal, or a tablet terminal. The printing apparatus 1 can print characters or pictures on a print medium on the basis of print data received from the external terminal. The print medium is, for example, a long sheet 36 formed by pasting a heat-sensitive label on backing paper. The printing apparatus 1 includes a housing 2 accommodating a roll sheet 3. Here, the roll sheet 3 includes the sheet 36 and a tape spool 42 around which the sheet 36 is wound. Hereinafter, a roll state indicates a state where the sheet 36 is wound around the tape spool 42. The sheet 36 is drawn from the housing 2 so as to be printed. The sheet 36 has an under surface on which sensor marks 14 (described later) are printed at predetermined pitches. The sensor marks 14 are used to detect an amount by which the sheet 36 has been conveyed.

The housing 2 has a box like shape formed with an opening at upper portion thereof. The housing 2 has a substantially rectangular shape when seen in a front view and a plane view. The housing 2 extends in a front-rear direction which is a longitudinal direction of the housing 2. The opening at the upper portion of the housing 2 is covered with a cover 5. The housing 2 has right and left side surfaces. Each of these side surfaces has an opening at a rear portion thereof. These openings are covered with the cover 5, as with the opening at the upper portion. The cover 5 is pivotably supported at a rear edge portion of the housing 2. The cover 5 includes a front end portion swung up or down about a rotation axis extending in a left-right direction so as to open or close the housing 2. The housing 2 with the cover 5 closed has an upper-rear portion having a substantially circular shape when seen in a side view and also has an upper-front portion inclined downwardly frontward.

A cut lever 9 is provided in front of the housing 2. The cut lever 9 is movable in the left-right direction. The cut lever 9 is coupled to a cutter unit 8 (FIG. 2). When the cut lever 9 is moved in the left-right direction, the cutter unit 8 is moved in the left-right direction so as to cut a sheet 36 after printing. The housing 2 includes a front end portion having an upper surface at which an entry key 7 is provided. The entry key 7 includes a power supply switch. A tabular tray 6 formed of a transparent resin is erected at a rear of the entry key 7. An ejection port 21 (see FIG. 2) is formed at a rear of the tray 6. The ejection port 21 is formed by a front end portion of the cover 5 and the housing 2 and extends in the left-right direction which is a longitudinal direction of the ejection port 21. The tray 6 receives a sheet 36 ejected through the ejection port 21 after printing. The housing 2 includes a rear surface. A first connector (not illustrated) and a second connector (not illustrated) are provided at a lower portion of the rear surface of the housing 2. A power source cord 10 (FIG. 2) is connected to the first connector (not illustrated). A USB cable (not illustrated) is connected to the second connector (not illustrated). The USB cable connects the second connector to an external terminal.

Figure 2:
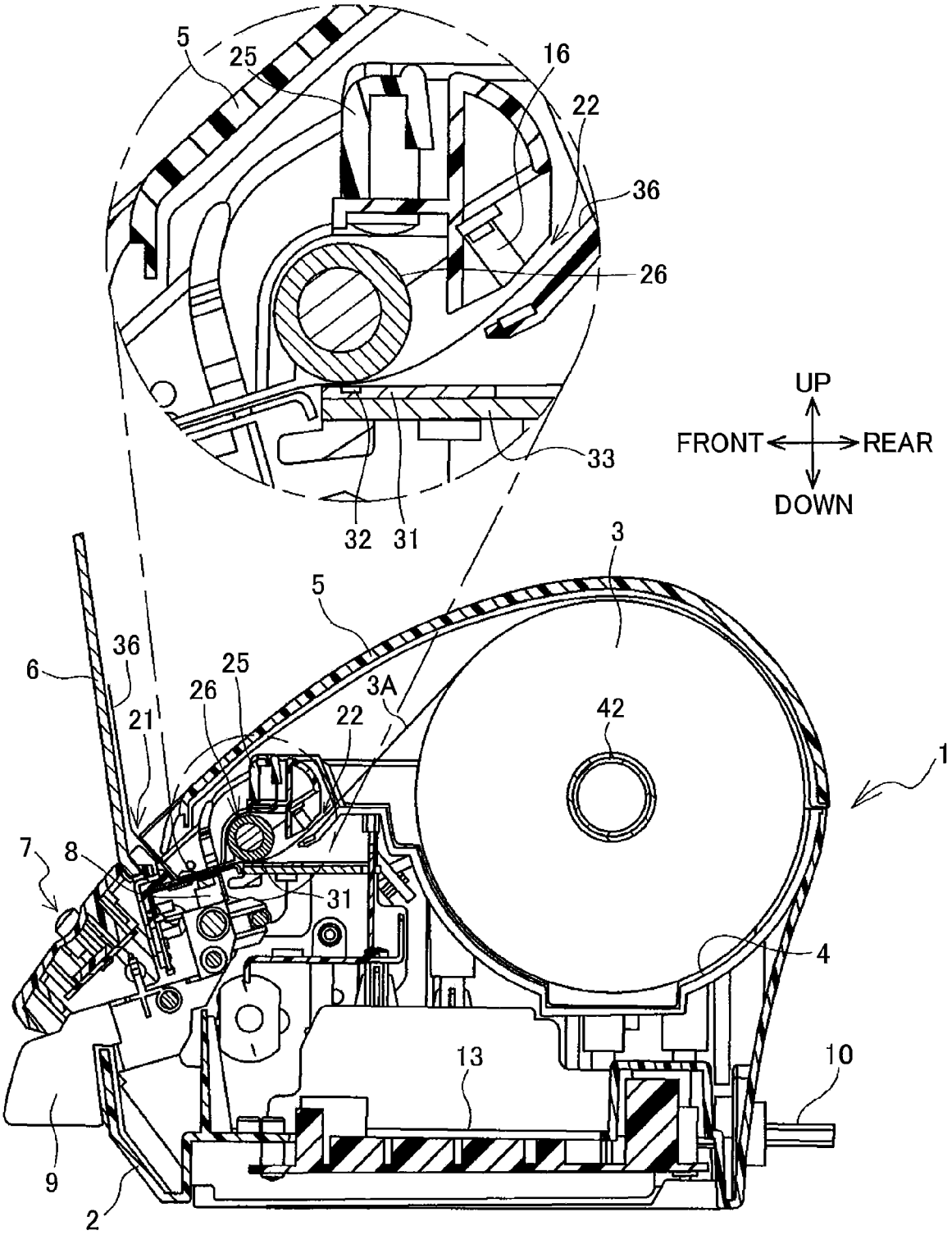
FIG. 2 is a cross section taken along II-II line shown in FIG. 1.

As shown in FIG. 2, a sheet storage 4 is provided in a rear portion of the housing 2. The sheet storage 4 has an arc shape recessed downward when seen in a side view. The sheet storage 4 opens upward. The sheet storage 4 also opens leftward and rightward. The sheet storage 4 stores the roll sheet 3. The roll sheet 3 is the sheet 36 in the roll state. The roll sheet 3 is wound around and held by the tape spool 42 with a printing surface of the roll sheet 3 facing a center of the tape spool 42 (a center of the circle defined by the circular shape of the tape spool 42 in the side view). The tape spool 42 has ends in the left-right direction which engage respective ones of support portions 41 (see FIG. 1). The support portions 41 are erected at end positions in the left-right direction in the sheet storage 4. The tape spool 42 rotatably supports the roll sheet 3 in the sheet storage 4. When the cover 5 is open, the tape spool 42 can be attached to or detached from the support portions 41. A control board 13 is disposed below the sheet storage 4. The control board 13 includes a CPU 51 (see FIG. 3) that controls an entirety of the printing apparatus 1.

A lever 11 (see FIG. 1) is provided at the vicinity of a left-front portion of the sheet storage 4. A roller holder 25 is provided at a position to the right of the lever 11. The roller holder 25 extends in the left-right direction and rotatably supports a platen roller 26. The lever 11 is always urged upward by a coil spring (not illustrated). When the cover 5 is closed, the lever 11 is pressed downward by the cover 5. The lever 11 is connected to the roller holder 25. The roller holder 25 is pivotally moved in an up-down direction about an axis at a rear edge thereof in conjunction with the lever 11 being pivoted in the up-down direction. When the lever 11 pivots downward. the roller holder 25 moves downward. A thermal head 31 is provided below the platen roller 26.

The housing 2 includes a conveyance path 22 extending downwardly frontward from a position in front of the sheet storage 4. A sheet 36 is drawn from the tape spool 42 in the sheet storage 41, and conveyed through the conveyance path 22. The platen roller 26 and the thermal head 31 are disposed substantially at a midpoint of the conveyance path 22 in the conveyance direction. The conveyance path 22 extends through a space between the platen roller 26 and the thermal head 31, and reaches the ejection port 21. The printing apparatus 1 performs printing on the sheet 36 while conveying the sheet 36 from the sheet storage 4 to the ejection port 21. In the following descriptions, a "conveyance direction" indicates a direction in which the sheet 36 is moved along the conveyance path 22. An optical sensor 16 for detecting the sensor marks 14 is provided on an upper side of the conveyance path 22. The optical sensor 16 is located at one end (right end) of the thermal head 31.

The thermal head 31 is a print head capable of heating a heat-sensitive label to develop colors of coloring matters contained in the heat-sensitive label, thereby forming dots. The thermal head 31 has a tabular shape and includes a plurality of heater elements 32 disposed on a top surface thereof. The plurality of heater elements 32 are arranged in one row in a main-scanning direction (left-right direction) orthogonal to the conveyance direction of the sheet 36. The total number of heater elements 32 arranged in one row is 1250. A sub-scanning direction refers to a direction orthogonal to the main-scanning direction, i.e., orthogonal to a direction in which the heater elements 32 are arranged. The sub-scanning direction coincides with the conveyance direction in the vicinity of the heater elements 32.

The platen roller 26 has an axis rotatably supported by the roller holder 25, and is located above the thermal head 31. An axial direction of the platen roller 26 is identical with the main-scanning direction parallel to the row of heater elements 32. The platen roller 26 faces the heater elements 32 of the thermal head 31. As shown in FIGS. 6-9, the thermal head 31 is urged toward the platen roller 26 by springs 34 and 35. Accordingly, a pressure (or a urging force) is applied to the sheet 36 nipped between the platen roller 26 and the thermal head 31. In this situation, the printing apparatus 1 can perform printing on the sheet 36. When the cover 5 open, the lever 11 is pivotally moved upward, and thus the roller holder 25 is moved upward. Hence, the platen roller 26 supported by the roller holder 25 is separated from the thermal head 31 and the sheet 36. In this situation, the printing apparatus 1 cannot perform printing on the sheet 36. The platen roller 26 is engaged with a conveyance motor 30 (see FIG. 3) via one or more gears (not illustrated) and rotated by the conveyance motor 30. The platen roller 26 is rotated to convey the sheet 36 nipped between the platen roller 26 and the thermal head 31.

The CPU 51 (see FIG. 3, described later) of the printing apparatus 1 controls an energy supply to each heater element 32 of the thermal head 31 so as to form on the sheet 36 a dot row in which dots are arranged in accordance with an arrangement of the heater elements 32. The dot row may be referred to as a line. The CPU 51 also controls the energy supply to the heater elements 32 in synchronization with drive control of the platen roller 26 so as to form a plurality of lines on the sheet 36. Here, the plurality of lines is arranged in parallel to each other in a direction orthogonal to a direction in which dots of each single line are arranged. The plurality of lines forms, on the sheet 36, characters or images in which light and shade are represented according to whether dots have been formed or not. In the following descriptions, the "main-scanning direction" also indicates a direction in which dots are arranged in one line formed on the sheet 36, and the "sub-scanning direction" also indicates a direction in which a plurality of lines formed on the sheet 36 is arranged in parallel to each other.

<Electrical Configuration of Printing Apparatus 1>

Figure 3:
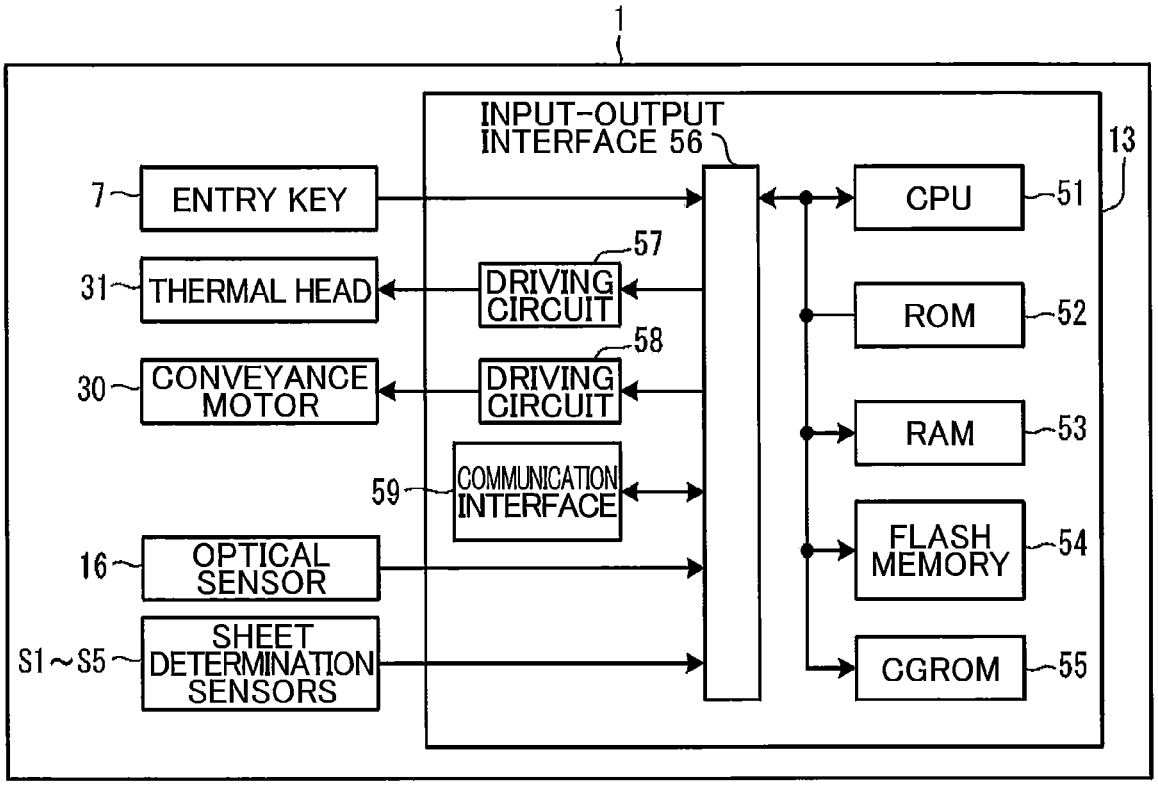
FIG. 3 is a block diagram illustrating an electrical configuration of the printing apparatus according to the embodiment.

An electrical configuration of the printing apparatus 1 will be explained while referring to FIG. 3. The printing apparatus 1 includes a control board 13. The control board 13 includes a CPU 51, a ROM 52, a RAM 53, a flash memory 54, and a CGROM 55, an input-output interface 56, driving circuits 57 and 58, a communication interface 59. The control board 13, more specifically the CPU 51, controls the printing apparatus 1. The CPU 51 is connected to the ROM 52, the RAM 53, the flash memory 54, and the CGROM 55. The ROM 52 stores various programs executed by the CPU 51. The ROM 52 also stores print program (described later) and tables including correction values shown in FIGS. 11-13. The RAM 53 stores various types of temporary data. The flash memory 54 stores various types of data. The flash memory 54 also stores factory settings values to be used in a process according to the print program. The CGROM 55 stores print dot pattern data for printing various characters on a sheet 36.

The CPU 51 is also connected to the entry key 7, the driving circuits 57 and 58, the communication interface 59, an optical sensor 16, and sheet determination sensors S1-S5 via the input-output interface 56. The entry key 7, which is provided on an upper surface of the printing apparatus 1 as shown in FIG. 1, accepts an input of a user operation. The driving circuit 57 supplies each heater element 32 provided at the thermal head 31 with energy. The CPU 51 controls heat generation of each heater element 32 by using the driving circuit 57. The driving circuit 58 drives the conveyance motor 30. The conveyance motor 30 is a pulse motor. The CPU 51 controls the conveyance motor 30 by using the driving circuit 58 so as to rotate the platen roller 26 in a manner such that the sheet 36 is conveyed at a predetermined speed on a line-by-line basis. The communication interface 59 communicates with an external terminal via a USB cable (not illustrated). The printing apparatus 1 receives print data from a PC via the USB cable. The communication interface 59 may communicate with an external terminal via Bluetooth (registered trademark) or a wireless LAN. The optical sensor 16 detects sensor marks 14 printed on the under surface of the sheet 36. The CPU 51 controls a position of the sheet 36 on the basis of a detected value of the optical sensor 16. The sheet determination sensors S1-S5 detect a type, material, and width of the sheet 36 (the roll sheet 3) and a surface of the sheet 36 on which the sensor marks 14 are printed.

As described above, on the basis of print data received from an external terminal, the CPU 51 performs a control as to whether or not to supply each heater element 32 with print energy while conveying the sheet 36 on a line-by-line basis, thereby forming dots on the sheet 36. The print data includes a value "1" indicating a portion of the sheet 36 on which a dot is formed and a value "0" indicating a portion on which a dot is not formed.

Figure 4:
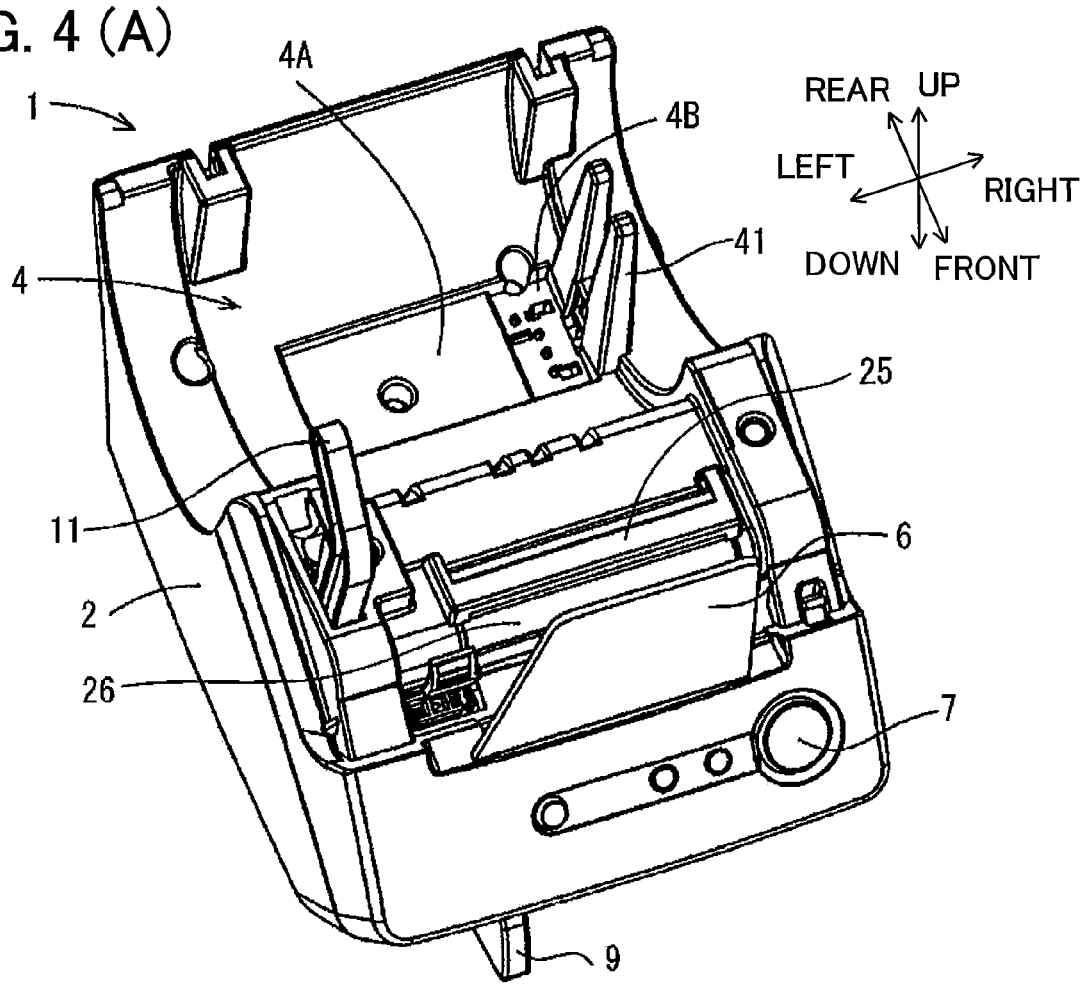
FIG. 4(A) is a perspective view of the printing apparatus with the cover detached.
FIG. 4(B) is an enlarged view of a determination recess.
Figure 4:
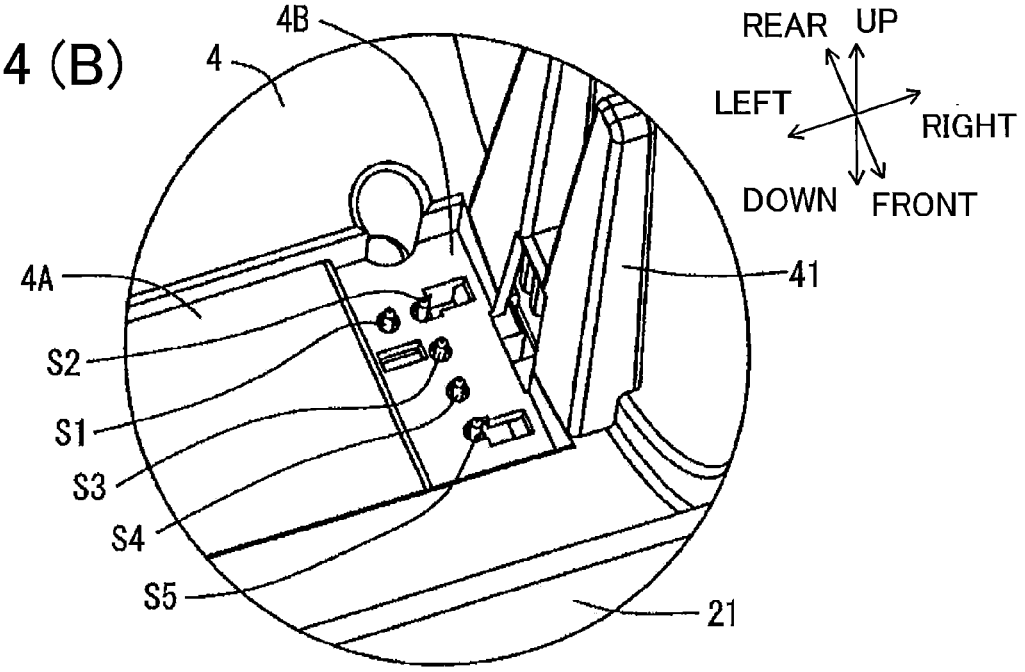

As shown in FIG. 4(A), a positioning recess 4A and a determination recess 4B are formed in a bottom surface of the sheet storage 4. The positioning recess 4A has a predetermined depth. The positioning recess 4A has a shape of a laterally long rectangle in a plane view. The determination recess 4B is closer to the support portion 41 than the positioning recess 4A to the support portion 41. The determination recess 4B has a predetermined depth deeper than that of the positioning recess 4A. The determination recess 4B has a shape of a vertically long rectangle in a plane view. The determination recess 4B faces a sheet determination part 60 (FIG. 5, described later) provided in a positioning member 12 of the roll sheet 3.

Next, the determination recess 4B will be described. As shown in FIG. 4(B), the determination recess 4B includes the five sheet determination sensors S1, S2, S3, S4, and S5 arranged in an L-shape. The sheet determination sensors S1, S2, S3, S4, and S5 used for determining a type of sheet, material for heat-sensitive sheet, a width of the roll sheet, and a surface on which the sensor marks 14 are printed (printing surface or under surface). The sheet determination sensors S1-S5 include mechanical switches provided with plungers and push-type microswitches. Each of the plungers has an upper end portion extending from a bottom surface of the determination recess 4B to a position in the vicinity of a bottom surface of the positioning recess 4A. According to this configuration of the determination recess 4B, the sheet determination sensors S1-S5 detects presence/absence of sensor holes 60A-60E (FIG. 5, described later) formed in the sheet determination part 60 for the roll sheet 3. On the basis of an ON signal or OFF signal output from the sheet determination sensors S1-S5, the CPU 51 identifies, for a mounted roll sheet 3, a type, material, a width, and a surface on which the sensor marks 14 are printed.

Figure 5:
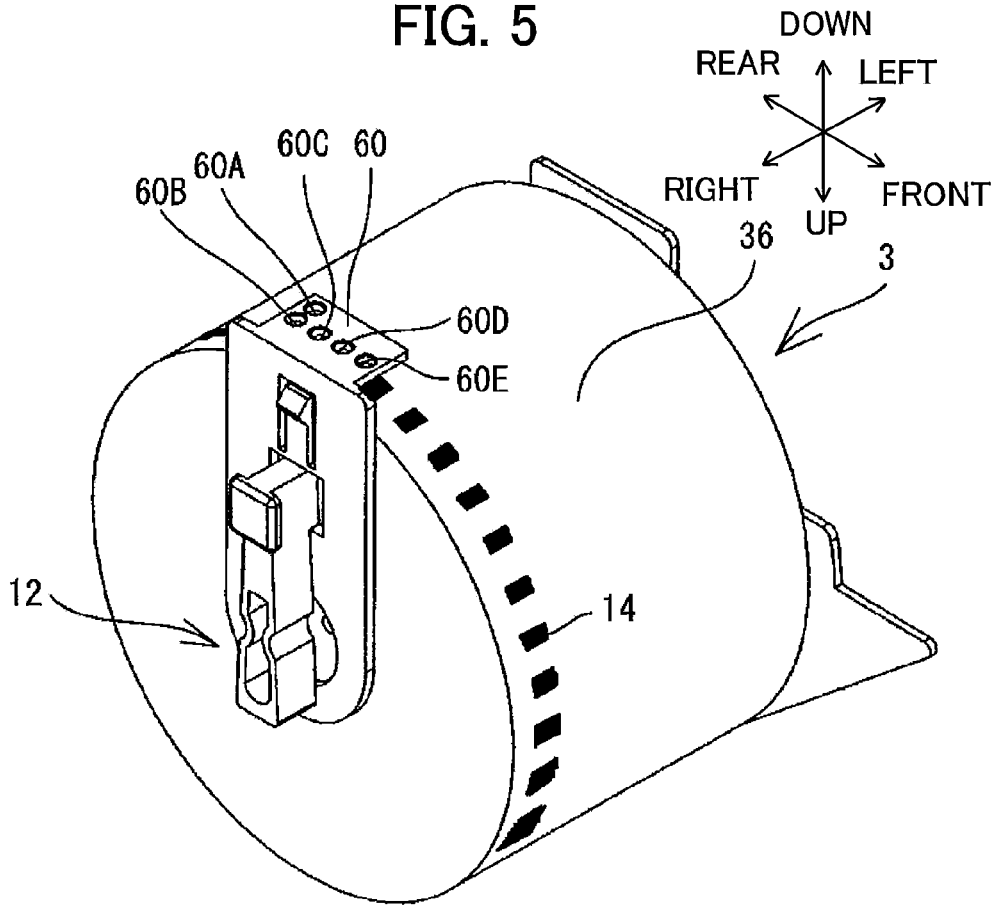
FIG. 5 is a perspective view of a roll sheet viewed from below

As shown in FIG. 5, the roll sheet 3 includes the positioning member 12 connected to the tape spool 42. The positioning member 12 is for positioning the sheet 36 with respect to the left-right direction. The positioning member 12 includes sensor holes 60A-60E for indicating a type of the roll sheet 3. A type of a roll sheet, material for a heat-sensitive sheet, a roll sheet width, and a surface on which the sensor marks 14 are printed are indicated in accordance with the presence/absence of the sensor holes 60A-60E.

<Head Pressure and Print Energy>

FIGS. 6-9 are explanation diagrams for illustrating a relationship between print energy and a head pressure of the thermal head 31 applied to the sheet 36 (361-364). A heat dissipation plate 33 is provided under the thermal head 31. The heat dissipation plate 33 and the thermal head 31 extend in the left-right direction. The heat dissipation plate 33 dissipates heat of the thermal head 31. A pair of springs 34 and 35 are provided under the heat dissipation plate 33. The printing apparatus 1 has an inner structure such that the spring 34 is in confrontation with (or is positioned, in the left-right direction, at) a substantial center of the thermal head 31. The spring 35 is in confrontation with (or is positioned, in the left-right direction, at) a portion of the thermal head 31 which is closer to a right end of the thermal head 31 than to a left end of the thermal head 31. Accordingly, a urging member that includes the pair of springs 34 and 35 is located closer to one end (right end) of the thermal head 31 than to another end (left end) of the thermal head 31 in the left-right direction. The springs 34 and 35 urge the thermal head 31 toward the platen roller 26. The springs 34 and 35 have an urging force to apply a pressure to a sheet 36 (361-364) nipped between the thermal head 31 and the platen roller 26. The sheet 36 (361-364) is conveyed with a right end thereof maintained closer to the right end of the thermal head 31 than to the left end of the thermal head 31. In this embodiment, the springs 34 and 35 are the same, and thus have the same length and spring constant.

Various types of sheets having different widths from one another are used in the printing apparatus 1. Four types of sheets 36, specifically sheets 361-364, are explained in the embodiment as sheets which have widths different from one another. FIGS. 6, 7, 8, and 9 respectively show the sheet 361, 362, 363, and 364. The width of the sheets 362, 361, 363, and 364 become narrower in this order. The width of each of the sheets 361-364 is specified by the sensor holes 60A-60B formed in the sheet determination part 60 in the corresponding roll sheet 3. The CPU 51 determines a width, material, and type of the sheet 36 by using the sheet determination sensors S1-S5.

Figure 6:
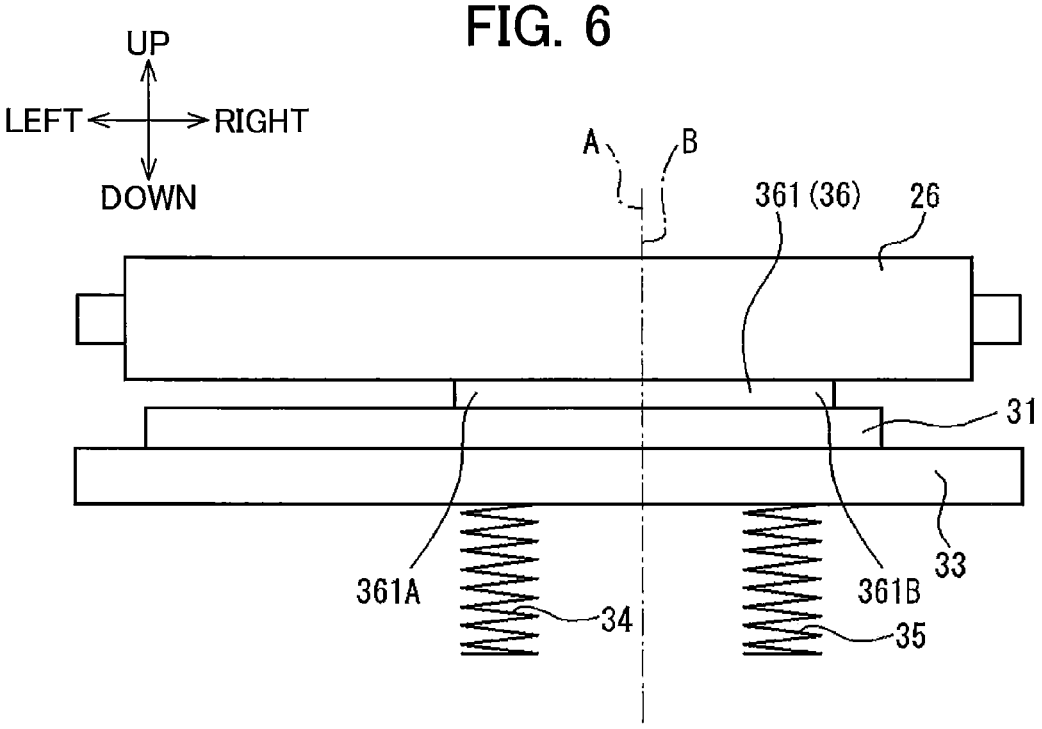
FIGS. 6-9 are examples of urged sheets between a thermal head and a platen roller.

First, a situation where the CPU 51 detects the sheet 361 will be explained while referring to FIG. 6. The sheet 361 has a second narrowest width among the four sheets 361-364. The sheet 361 has a left end portion 361A and a right end portion 361B. The left end portion 361A is in confrontation with (or is positioned, in the left-right direction, at) the spring 34, and the right end portion 361B is in confrontation with (or is positioned, in the left-right direction, at) the spring 35. Accordingly, a sheet center A that is a center of the sheet 361 in the left-right direction coincides with a load center B that is a midpoint between a point to which the spring 34 applies a pressing force and a point to which the spring 35 applies a pressing force. In other words, the load center B is a position of a center of pressure(s) (or urging force(s)) which is (are) generated by the urging member including the springs 34 and 35 and applied to the heat dissipation plate 33 (the thermal head 31). The center of pressure(s) (or urging force(s)) is the average location of the pressure(s) (or urging force(s)) generated by the urging member (the springs 34 and 35) and applied to the heat dissipation plate 33 (the thermal head 31). Here, the average location of the pressure is a first value divided by a second value, where the first value is obtained by a sum of positions multiplied by pressures (or urging force(s)) thereat, and the second value is a sum of the pressures (or urging force(s)). Hence, equal pressures are applied to the left end portion 361A and the right end portion 361B, i.e., the pressures have a ratio of 1:1. For the sheet 361, the CPU 51 equalize all print energies for the thermal head 31 in the left-right direction (the heater elements 32) on the basis of a correction value table (described later) stored in the ROM 52.

Figure 7:
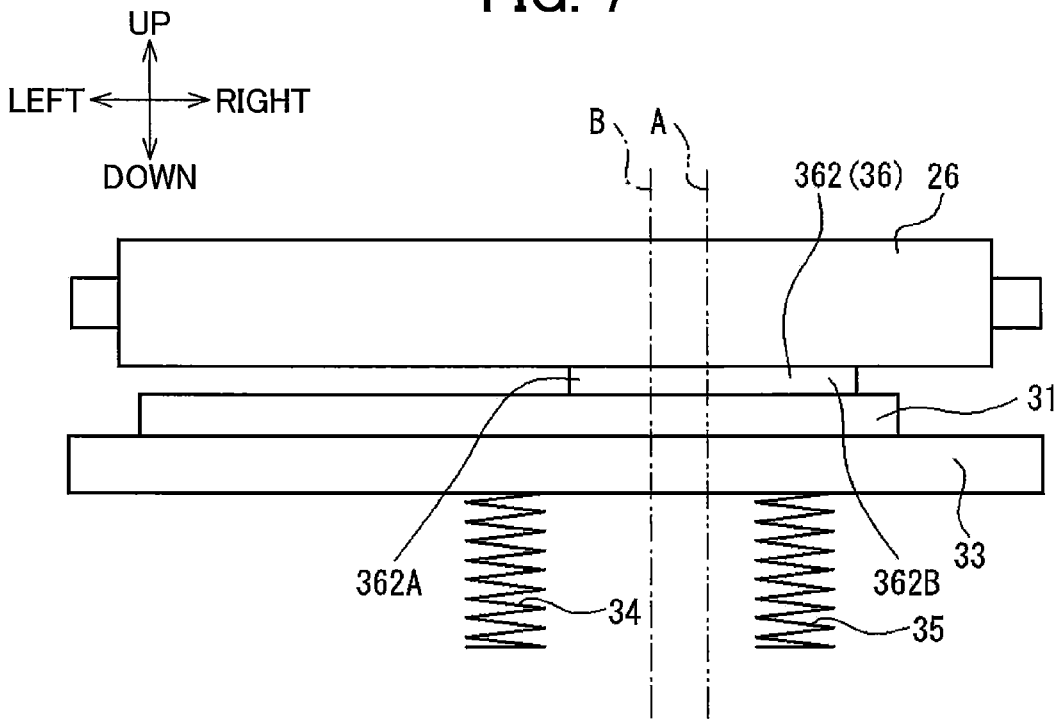

Next, a situation in which the CPU 51 detects the sheet 362 will be explained while referring to FIG. 7. The sheet 362 has a narrowest width among the four sheets 361-364. The sheet 362 has a left end portion 362A and a right end portion 362B. The left end portion 362A is not in confrontation with the spring 34, and is shifted rightward from the position of the spring 34. The right end portion 362B is in confrontation with (or is positioned, in the left-right direction, at) the spring 35. Accordingly, the load center B of the pressing forces applied by the springs 34 and 35 shifts leftward from the sheet center A, i.e., the midpoint of the sheet 362 in the left-right direction. Thus, the left end portion 362A of the sheet 362 receives a pressure higher than the pressure received by the right end portion 362B of the sheet 362. For example, the pressure applied to the left end portion 362A and the pressure applied to the right end portion 362B have a ratio of 1.5:0.5 therebetween. On the basis of the correction value table stored in the ROM 52, the CPU 51 sets higher print energy for the right portion of the thermal head 31 than that for the left portion of the thermal head 31. Here, the right portion of the thermal head 31 is farther away from the load center B than the left portion of the thermal head 31 from the load center B. The right portion of the thermal head 31 receives a pressure lower than that received by the thermal head 31.

Figure 8:
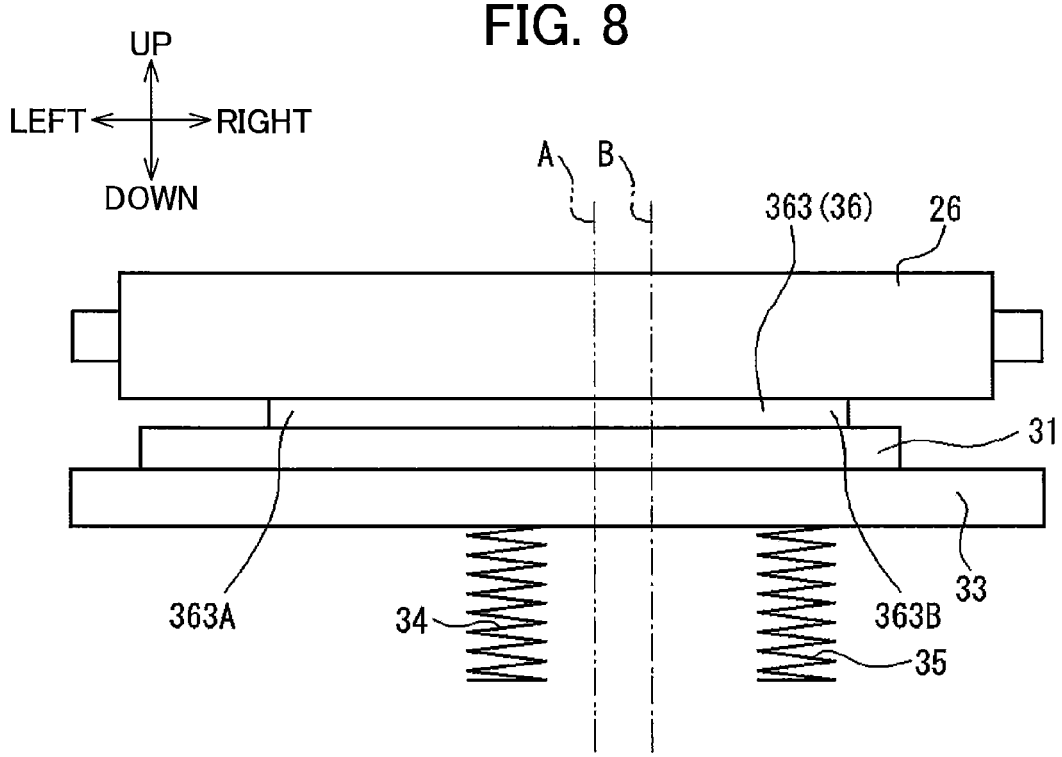

Next, a situation in which the CPU 51 detects the sheet 363 will be explained while referring to FIG. 8. The sheet 363 has a second widest width among the four sheets 361-364. The sheet 363 has a left end portion 363A and a right end portion 363B. The left end portion 363A is not in confrontation with the spring 34, and is shifted leftward from the position of the spring 34. The right end portion 363B is in confrontation with (or is positioned, in the left-right direction, at) the spring 35. Accordingly, the load center B of the pressing forces applied by the springs 34 and 35 shifts rightward from the sheet center A, i.e., the midpoint of the sheet 363 in the left-right direction. Thus, the right end portion 363B receives a pressure higher than the pressure received by the left end portion 363A. For example, the pressure applied to the left end portion 363A and the pressure applied to the right end portion 363B may have a ratio of 0.5:1.5 therebetween. On the basis of the correction value table stored in the ROM 52, the CPU 51 sets higher print energy for the left portion of the thermal head 31 than that for the right portion of the thermal head 31. Here, the left portion of the thermal head 31 is farther away from the load center B than the left portion of the thermal head 31 from the load center B. The left portion of the thermal head 31 receives a pressure lower than that received by the right portion of the thermal head 31.

Figure 9:
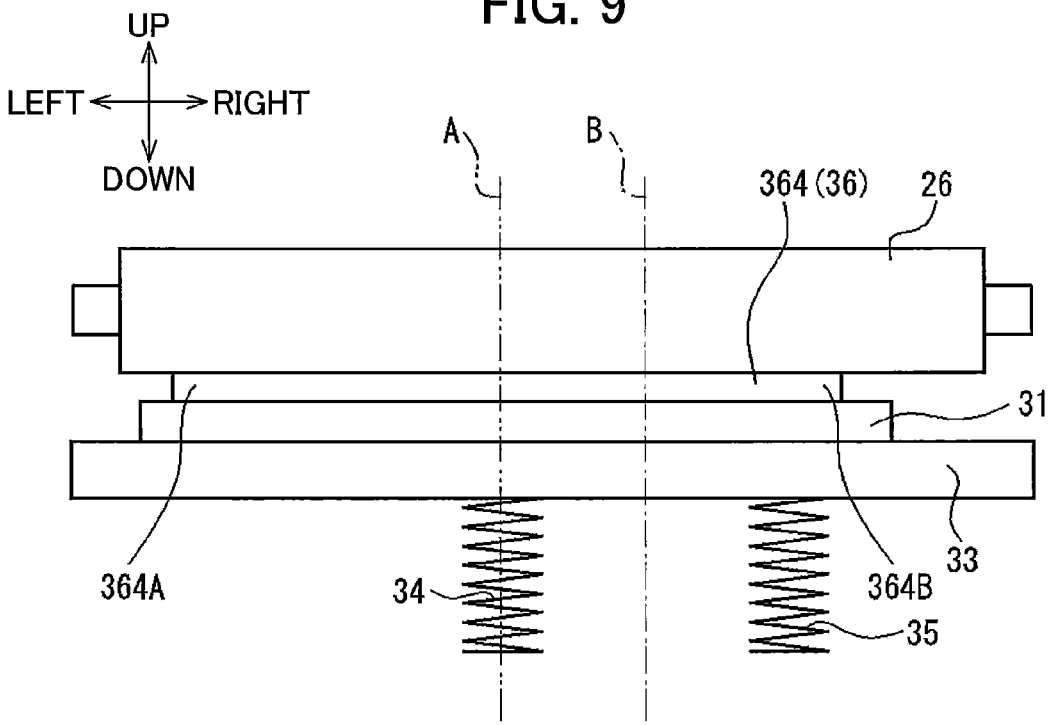

Next, a situation in which the CPU 51 detects the sheet 364 will be explained while referring to FIG. 9. The sheet 364 has a widest width among the four sheets 361-364. The sheet 364 has a left end portion 364A and a right end portion 364B. The left end portion 364A is not in confrontation with the spring 34 and is shifted leftward from the position of the spring 34. The spring 34 is in confrontation with (or is positioned, in the left-right direction, at) the sheet center A of the sheet 364. The right end portion 364B is in confrontation with (or is positioned, in the left-right direction, at) the spring 35 in the left-right direction. Accordingly, the load center B of the pressing forces applied by the springs 34 and 35 shifts rightward from the sheet center A, i.e., the midpoint of the sheet 364 in the left-right direction. Thus, the right end portion 364B receives a pressure much higher than the pressure applied to the left end portion 364A. For example, the pressure applied to the left end portion 364A and the pressure applied to the right end portion 364B have a ratio of 0.33:1.66 therebetween. On the basis of the correction value table stored in the ROM 52, the CPU 51 sets higher print energy for the left portion of the thermal head 31 than that for the right portion of the thermal head 31. Here, the left portion of the thermal head 31 is farther away from the load center B than the right portion of the thermal head 31 from the load center B. The left portion of the thermal head 31 receives a pressure lower than that received by the right portion of the thermal head 31.

First Example

Figure 10:
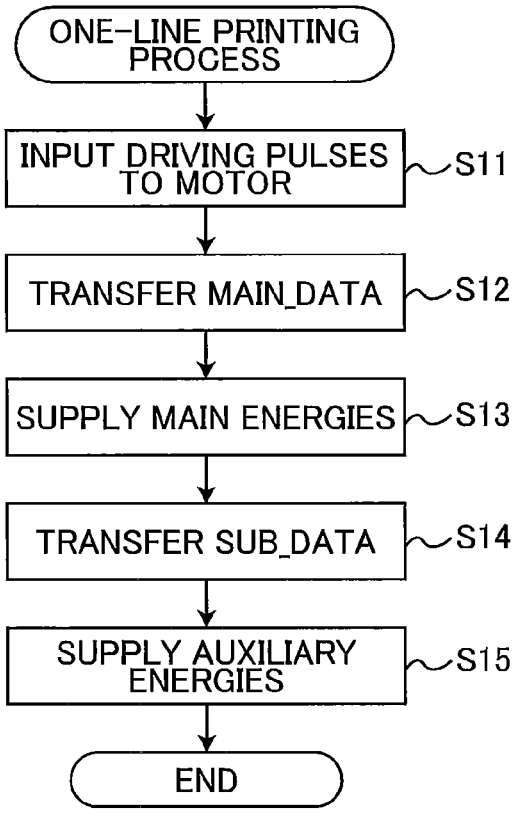
FIG. 10 is a flowchart illustrating a one-line printing process.

A first example of a printing process will be explained while referring to FIGS. 10-12. The printing process is performed by executing the print program. A medium MA (FIGS. 11 and 12) is used in the embodiment. The medium MA is heat-sensitive paper having a thickness of 160 μm. There are two types of medium MA, one of which has a width of 100 mm, and the other of which is 50 mm in width. The sheet 364 (FIG. 9) is an example of the medium MA having a width of 100 mm. The sheet 362 (FIG. 7) is an example of the medium MA having a width of 50 mm A medium MB is also used in the embodiment. The medium MB is a heat-sensitive film having a thickness of 130 μm and a width of 100 mm. The CPU 51 determines a width and type of a sheet 36 using the sheet determination sensors S1-S5.

Various variables are used while executing the print program. The variables includes MAIN_DATA and SUB_DATA. The MAIN_DATA includes array variables for storing print data received from an external terminal by the printing apparatus 1. In the MAIN_DATA, each array variable corresponds to one dot in the print data and also corresponds to one heater element 32, and array variables in one line corresponds to respective ones of the heater elements 32 arranged in line. In The MAIN_DATA, a value "1" is stored in an array variable corresponding to a heater element 32 to which main energy is to be supplied, and a value "0" is stored in an array variable corresponding to a heater element 32 to which no main energy is to be supplied. The SUB_DATA also includes array variables for storing information indicating whether auxiliary energy is to be supplied. In the SUB_DATA, each array variable corresponds to one dot in the print data and array variables in one line corresponds to respective ones of the heater elements 32 arranged in line. In SUB_DATA, a value "1" is stored in an array variable corresponding to a heater element 32 to which auxiliary energy is to be supplied, and a value "0" is stored in an array variable corresponding to a heater element 32 to which no auxiliary energy is to be supplied.

First Example of One-Line Printing Process

The following describes a first example of a one-line printing process. The one-line printing process is such that the thermal head 31 prints one line on the sheet 36. The one-line printing process is repeated a plurality of times so as to form an entire image of the print data on the sheet 36. In S11 of FIG. 10, the CPU 51 drives the conveyance motor 30 by using the driving circuit 58 so as to input driving pulses to the conveyance motor 30. For example, the CPU 51 inputs driving pulses corresponding to a conveyance speed of 110 mm/s to the conveyance motor 30. The sheet 36 starts to be conveyed by one line at the conveyance speed of 110 mm/s. In S12 the CPU 51 transfers one line worth of MAIN_DATA to the driving circuit 57 for the thermal head 31. In S13 the driving circuit 57 supplies main energies to corresponding heater elements 32 on the basis of the transferred one line worth of MAIN_DATA.

Specifically, in S13, a strobe signal is supplied to each heater element 32 in order to supply the energy thereto in a case where the value "1" is stored in an array variable in the MAIN_DATA corresponding to the each heater element 32. FIG. 11 is a table for illustrating correction values for correcting an ON duration of time in a strobe signal. Hereinafter, this ON duration of time is referred to as a Ton duration of time. The thermal head 31 shown in FIGS. 6-9 includes the heater elements 32 that correspond to dots 1-1250 in the main-scanning direction (specifically, from left to right). Each heater element 32 of the thermal head 31 produces heat for the Ton duration. Correction values for a medium MA having a width of 100 mm are as follows. A correction value is "1.1" for a strobe signal STB1 that corresponds to dots 1-250 in the main-scanning direction. A correction value is "1.05" for a strobe signal STB2 that corresponds to dots 251-500 in the main-scanning direction. A correction value is "1" for strobe signal STB3 that corresponds to dots 501-750 in the main-scanning direction, for a strobe signal STB4 that corresponds to dots 751-1000 in the main-scanning direction, and for a strobe signal STB5 that corresponds to dots 1001-1250 in the main-scanning direction. Accordingly, the CPU 51 sets high print energy for the left portion of the thermal head 31 which is distant from the load center B and receives a low pressure. The CPU 51 sets low print energy for the right portion of the thermal head 31 in the left-right direction which is close to the load center B and receives a high pressure. In other words, the CPU 51 sets higher print energy for the left portion of the thermal head 31 than that for the right portion of the thermal head 31 in a case where the left portion is farther away from the load center B than the right portion from the load center B, or in a case where the left portion receives a pressure lower than a pressure received by the right portion. Here, the right portion of the thermal head 31 indicates a portion of the thermal head 31 positioned at right hand side of the load center B and the left portion of the thermal head 31 indicates a portion of the thermal head 31 positioned at left side of the load center B. Alternatively, the right portion of the thermal head 31 is located at the same position of the right end portion of the sheet 36 in the left-right direction and the left end portion of the thermal head 31 is located at the same position of the left end portion of the sheet 36 in the left-right direction.

For a medium MA having a width of 50 mm shown in FIG. 11, none of the strobe signals STB1 and STB2 is supplied to the corresponding heater elements 32. This is because the width of the medium MA (50 nm) is narrow. Hence, the heater elements 32 that correspond to dots 1-500 in the main-scanning direction do not produce heat. In this case, a correction value is "1" for the strobe signal STB3 that corresponds to dots 501-750 in the main-scanning direction and for the strobe signal STB4 that corresponds to dots 751-1000 in the main-scanning direction. A correction value is "1.1" for the strobe signal STB5 that corresponds to dots 1001-1250 in the main-scanning direction. Accordingly, the CPU 51 sets high print energy for the right portion of the thermal head 31 in the left-right direction which is distant from the load center B and receives a low pressure. The CPU 51 sets low print energy for the left portion of the thermal head 31 in the left-right direction which is close to the load center B and receives a high pressure. In other words, the CPU 51 sets higher print energy for the right portion of the thermal head 31 than that for the left portion of the thermal head 31 in a case where the right portion is farther away from the load center B than the left portion from the load center B, or in a case where the right portion receives a pressure lower than a pressure received by the left portion.

Correction values for a medium MB having a width of 100 mm as shown in FIG. 11 are as follows. A correction value is "1.2" for the strobe signal STB1 that corresponds to dots 1-250 in the main-scanning direction. A correction value is "1.15" for the strobe signal STB2 that corresponds to dots 251-500 in the main-scanning direction has. A correction value is "1.1" for the strobe signal STB3 that corresponds to dots 501-750 in the main-scanning direction, and for the strobe signal STB4 that corresponds to dots 751-1000 in the main-scanning direction. A correction value is "1" for the strobe signal STB5 that corresponds to dots 1001-1250 in the main-scanning direction. As in the case of the medium MA that is 100 mm in width, the CPU 51 sets high print energy and low print energy respectively for the left portion and the right portion of the thermal head 31 in the left-right direction, even though the material for the medium MB is different from that for the medium MA. Meanwhile, higher energies are supplied for the medium MB than those supplied for the medium MA because the medium MB is a heat-sensitive film and thus needs to be heated to a higher degree than the medium MA (heat-sensitive paper).

Next, descriptions are given of specific examples of a Ton duration for a strobe signal STB corresponding to a correction value "1" by referring to FIG. 12. The Ton duration is varied according to material for a medium, a conveyance speed of the medium, a temperature of the thermal head 31 (hereinafter, referred to as a head temperature), and an environmental temperature. The conveyance speed of the medium is 110 mm/sec. For the medium MA having the width of 100 mm, for example, the Ton duration is 325 μs when the head temperature is 5 degrees Celsius, 310 μs when the head temperature of the thermal head 31 is 23 degrees Celsius, and 280 μs when the head temperature of the thermal head 31 is 40 degrees Celsius. For the medium MA having the width of 50 mm, the Ton duration may be 325 μs when the head temperature is 5 degrees Celsius, 310 μs when the head temperature of the thermal head 31 is 23 degrees Celsius, and 280 μs when the head temperature of the thermal head 31 is 40 degrees Celsius. For the medium MB having the width of 100 mm, the Ton duration may be 400 μs when the head temperature is 5 degrees Celsius, 380 μs when the head temperature of the thermal head 31 is 23 degrees Celsius, and 360 μs when the head temperature of the thermal head 31 is 40 degrees Celsius. When the strobe signal STB shown in FIG. 11 is corrected by a correction value "1.1", each Ton duration has a length equal to 1.1 times the length of the above-described corresponding Ton duration when the correction value is 1. When the correction value is corrected by a correction value "1.05", the Ton duration has a length equal to 1.05 times the length of the above-described corresponding Ton duration when the correction value is 1. When the correction value is corrected by a correction value "1.2", the Ton duration has a length equal to 1.2 times the length of the above-described corresponding Ton duration when the correction value is 1. When the correction value is corrected by a correction value "1.15", the Ton duration has a length equal to 1.15 times the length of the above-described corresponding Ton duration when the correction value is 1. Tables shown in FIGS. 11 and 12 are stored in the ROM 52 and read by the CPU 51. The CPU 51 selects one Ton duration from among the Ton durations stored in the table shown in FIG. 11 based on the type of medium, width of the medium, and the head temperature, and sets the Ton duration for each of the strobe signals STB1-STB5 by correcting the Ton durations (by multiplying the Ton duration by the corresponding correction value stored in the table shown in FIG. 11).

After the main energy is supplied in S13, in S14 the CPU 51 transfers one-line worth of SUB_DATA to the driving circuit 57 for the thermal head 31. In the first example, all array variables in SUB_DATA are set to the value "0", and thus in S15 the driving circuit 57 supplies no auxiliary energy to corresponding heater elements 32 on the basis of the transferred SUB_DATA. Accordingly, one line is printed on the sheet 36.

Second Example

Next, a history control (SUB_ON) is explained while referring to FIGS. 10 and 13-15. FIG. 13 is a table indicating for each of strobe signals STB1-STB5 whether to set a SUB pulse to ON or not. The table shown in FIG. 13 is stored in the ROM 52 and read by the CPU 51. For a medium MA having a width of 100 mm, as shown in FIG. 13, the strobe signals STB1 and STB2 have SUB pulses of ON, and the strobe signals STB3-STB5 have SUB pulses of OFF. Accordingly, the heater elements 32 that correspond to dots 1-500 in the scanning direction produce an amount of heat corresponding to the SUB pulses, and the heater elements 32 that correspond to dots 501-1250 do not produce heat according to the SUB pulses. Therefore, the CPU 51 sets high print energy for the left portion of the thermal head 31 in the left-right direction which is distant from the load center B and receives a low pressure. The CPU 51 sets low print energy for the right portion of the thermal head 31 in the left-right direction which is close to the load center B and receives a high pressure. In other words, the CPU 51 sets higher print energy for the left portion of the thermal head 31 than that for the right portion of the thermal head 31 in a case where the left portion is farther away from the load center B than the right portion from the load center B, or in a case where the left portion receives a pressure lower than a pressure received by the right portion.

For a medium MA having a width of 50 mm, the strobe signals STB1 and STB2 have no SUB pulses, the strobe signals STB3 and STB4 have SUB pulses of OFF, and the strobe signal STB5 has a SUB pulse of ON. Accordingly, the heater elements 32 that correspond to dots 1001-1250 in the scanning direction produce an amount of heat corresponding to the SUB pulses. The heater elements 32 that correspond to dots 501-1000 do not produce heat according to the SUB pulses. Therefore, the CPU 51 sets high print energy for the right portion of the thermal head 31 in the left-right direction which is distant from the load center B and receives a low pressure. The CPU 51 sets low print energy for the left portion of the thermal head 31 in the left-right direction which is close to the load center B and receives a high pressure. In other words, the CPU 51 sets higher print energy for the right portion of the thermal head 31 than that for the left portion of the thermal head in a case where the right portion is farther away from the load center B than the left portion from the load center B, or in a case where the right portion receives a pressure lower than a pressure received by the left portion.

For a medium MB having a width of 100 mm, the strobe signals STB1 and STB2 have SUB pulses of ON, and the strobe signals STB3-STB5 have SUB pulses of OFF, i.e., print energy is supplied to the thermal head 31. Accordingly, the heater elements 32 that correspond to dots 1-500 in the scanning direction produce an amount of heat corresponding to the SUB pulses, and the heater elements 32 that correspond to dots 501-1250 do not produce heat according to the SUB pulses. Therefore, the CPU 51 sets high print energy for the left portion in the left-right direction of the thermal head 31 which is distant from the load center B and receives a low pressure. The CPU 51 sets low print energy for the right portion in the left-right direction which is close to the load center B and receives a high pressure. In other words, the CPU 51 sets higher print energy for the left portion of the thermal head 31 than that for the right portion of the thermal head 31 in a case where the left portion is farther away from the load center B than the right portion from the load center B, or in a case where the left portion receives a pressure lower than a pressure received by the right portion.

Figure 14:
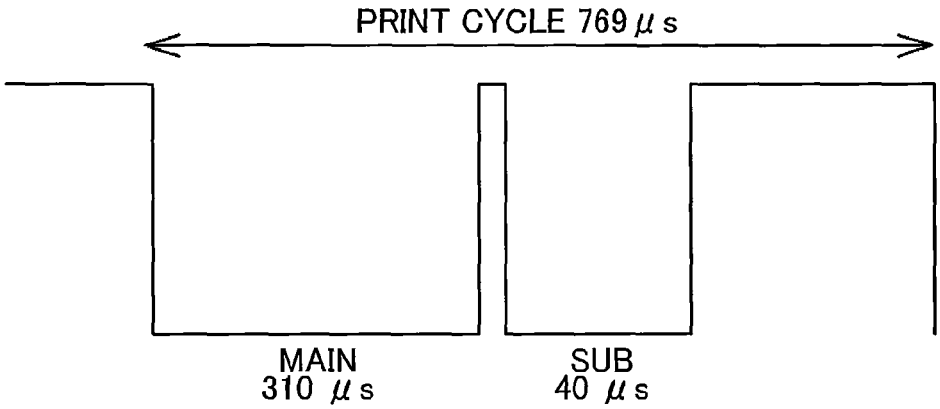
Figure 15:
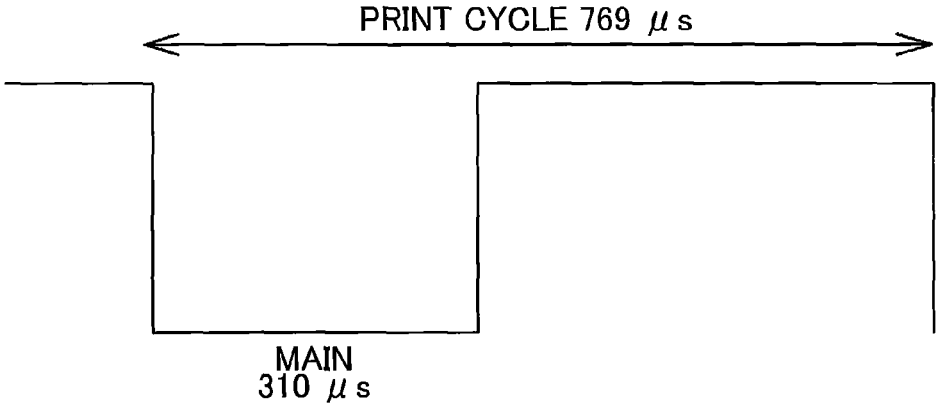
FIG. 15 is a waveform when the SUB pulse is OFF.

FIG. 14 shows a waveform for driving the heater element 32 with a SUB pulse ON. In this example, a print cycle is 769 μs, a MAIN pulse has an ON duration of 310 μs, and a SUB pulse has an ON duration of 40 μs. FIG. 15 shows a waveform for driving the heater element 32 with a SUB pulse OFF. In this example, the print cycle is 769 μs, the MAIN pulse has an ON duration of 310 μs, and the SUB pulse does not have an ON duration.

Second Example of One-Line Printing Process

A second example of a one-line printing process will be explained. In S11 of FIG. 10, the CPU 51 drives the conveyance motor 30 by using the driving circuit 58 so as to input driving pulses to the conveyance motor 30. For example, the CPU 51 inputs driving pulses corresponding to a conveyance speed of 110 mm/s to the conveyance motor 30. The sheet 36 starts to be conveyed by one line at a conveyance speed of 110 mm/s. In S12 the CPU 51 transfers one-line worth of MAIN_DATA to the driving circuit 57 for the thermal head 31. In S13 the driving circuit 57 supplies main energy to corresponding heater elements 32 on the basis of the transferred one line-worth of MAIN_DATA. In this situation, Ton durations of the MAIN_DATA are not corrected, i.e., all correction values are 1, unlike in the example shown in FIG. 11.

After the main energy is supplied in S13, in S14 the CPU 51 transfers one-line worth of SUB_DATA to the driving circuit 57 for the thermal head 31. In the second example, the SUB_DATA depends on the table shown in FIG. 13. In S15 the driving circuit 57 supplies auxiliary energy to corresponding heater elements 32 on the basis of the transferred one-line worth of SUB_DATA. Here, the CPU 51 supplies the auxiliary energy to each heater element 32 in a case where an array variable corresponding to the each heater element 32 in the SUB_DATA has a value "1" and a case where the strobe signal corresponding to the each heater element 32 in the table shown in FIG. 13 is set to ON. Accordingly, one line is printed on the sheet 36.

As described above, the sheet 36 receives pressure from the springs 34 and 35 and the pressure varies according to position of the sheet 36 in the left-right direction. The pressure at a position depends on a distance to the position and from the position of the sheet 36 and the load center B. The pressure increases as the position in the sheet 36 approaches the load center B. The distribution of the pressure depends on the widthwise length of the sheet 36. The CPU 51 sets the energy to the thermal head 31 on the basis of the varying pressure. Specifically, the lower pressure a portion of the sheet 36 receives, the higher energy the CPU 51 sets for the heater element 32 which is located at a position of this portion of the sheet 36 in the left-right direction.

In the embodiment described above, as portions of the sheet 36 receiving a lower pressure, the CPU 51 sets higher energy to be supplied to the corresponding thermal head 31, as described above. Hence, a print density can be ensured even for portions of the sheet 36 receiving a low pressure so that print blurring can be prevented from occurring. Accordingly, even when the urging member that includes the springs 34 and 35 can be disposed only at a limited position, a print quality can be ensured, thereby increasing a degree of flexibility in design.

In the embodiment described above, the pressure applied to a position on the sheet 36 are varied according to the distance to the position on the sheet 36 from the load center B, i.e., the center of the pressures applied to the sheet 36. The CPU 51 controls energy to be supplied to a portion of the thermal head 31 in accordance with the distance to this portion of the thermal head 31 from the load center B, i.e., the center of pressures, so that a print density can be ensured even for portions of the sheet 36 receiving a low pressure, thereby preventing print blurring from occurring. Accordingly, even when the urging member that includes the springs 34 and 35 can be disposed only at a limited position, a print quality can be ensured, thereby increasing the degree of flexibility in design.

In the embodiment described above, the load center B, i.e., the center of the pressures applied to the sheet 36, depends on the width of the sheet 36. Pressures applied to a portion of the sheet 36 are varied according to the distance from the load center B to this portion of the sheet 36. Using width information of the sheet 36 obtained by the sheet determination sensors S1-S5, the CPU 51 controls energy to be supplied to a portion of the thermal head 31 in accordance with the distance to this portion of the thermal head 31 from the load center B, i.e., the center of pressures. Hence, a print density can be ensured even for portions of the sheet 36 receiving a low pressure so that print blurring can be prevented from occurring. Accordingly, even when the urging member that includes the springs 34 and 35 can be disposed only at a limited position, a print quality can be ensured, thereby increasing the degree of flexibility in design.

The CPU 51 can control energy to be supplied to a portion of the thermal head 31 in accordance with the distance to this portion of the thermal head 31 from the load center B so as to ensure a print density, thereby preventing print blurring from occurring. The CPU 51 can control energy to be supplied depending on the width of the sheet 36 so as to ensure a print density, thereby preventing print blurring from occurring. In addition, the CPU 51 can control energy to be supplied depending on the position of a conveyed sheet 36 relative to the position of the thermal head 31, so as to ensure a print density, thereby preventing print blurring from occurring. Moreover, the CPU 51 controls energy to be supplied by referring to the correction value table so that the energy to be supplied can be easily controlled.

In the embodiment described above, the optical sensor 16 for reading the sensor marks 14 is disposed on one end (right end) of the thermal head 31. Accordingly, the sheet 36 is conveyed with one end thereof maintained closer to the one end (right end) of the thermal head 31 than to another end (left end) of the thermal head 31, and the urging member that includes the springs 34 and 35 is positioned closer to the one end of the thermal head 31 than to the another end (left end) of the thermal head 31. Thus, the pressure applied to the sheet 36 is varied between positions in the width direction. The CPU 51 sets higher energy to be supplied to the thermal head 31 for portions of the sheet 36 receiving a lower pressure, so that a print density can be ensured even for portions of the sheet 36 receiving a low pressure, thereby preventing print blurring from occurring.

In the embodiment described above, the platen roller 26 is an example of the "platen" of the present disclosure, a pair of the springs 34 and 35 is an example of the "urging member", and the CPU 51 is an example of the "processor". The sheet determination sensors S1-S4 are an example of the "sensor acquiring width-information". The ROM 52 is an example of the "storage storing a table". The sheet 36 is an example of the "sheet or printing sheet". As shown in FIGS. 6-9, the sheet 36 is conveyed with the right end thereof maintained close to the right end of the thermal head 31. Accordingly, the tables shown in FIGS. 11 and 13 store widths of sheets 36, so that the position of a conveyed sheet 36 relative to the position of the thermal head 31 can be determined by referring to these widths. Thus, the tables shown in FIGS. 11 and 13 are examples of the "table indicating a width of a sheet and a relationship between energy to be supplied and a position of the conveyed sheet relative to a position of a thermal head". The ROM 52 is an example of the "storage".

The present invention is not limited to the described embodiment and can have various modifications made thereto. For example, the one-line printing process may be performed by combining the correction of the Ton duration of MAIN pulses of the first example with the SUB pulses of the second example. For example, the CPU 51 may control main energy by referring to the correction value table and supply auxiliary energy based on basis of SUB pluses.

The CPU 51 may determine energy to be supplied by using a function that correlates the energy at position with the distance to this position from the load center B as a parameter. In this case, the energy to be supplied can be easily controlled. Alternatively, the CPU 51 may determine the energy to be supplied by using one of functions which are provided for respective ones of different types of sheets 36 to be detected by the sheet determination sensors S1-S5, so that the energy to be supplied can be easily controlled. Here, each of the functions correlates the energy at position with the distance to this position from the load center B as a parameter.

The sheet 36 may be a laminated medium having a surface to be covered with a transparent base material after printing thereon is performed or may be a receptor medium having a surface to be uncovered after printing is performed thereon. In a case where a laminated medium and a receptor medium having the same width, the CPU 41 sets energy so that, for each heater element 32 to which energy is to be supplied (corresponding to a dot to be formed in the MAIN_DATA), the energy to be supplied to the each heater element 32 for the receptor medium is larger than the energy to be supplied to the each heater element 32 for the laminated medium. Energy to be supplied to each of one or more specific heater elements 32 may be equivalent for the receptor medium and the laminated medium. In another case where the difference in pressure between a highest pressure at a highest pressure portion and a lowest pressure at a lowest pressure portion is the same for laminated medium and the receptor medium, the CPU 51 sets energy so that a difference in energy for the receptor medium between energy supplied to the lowest pressure portion and energy supplied to the highest pressure portion is larger than that difference in energy for the laminated medium. Here, the highest pressure portion is a portion of the medium receiving highest pressure and the lowest pressure portion is a portion of the medium receiving low pressure. The highest pressure portion of the receptor medium may be located on a position equal to or different from that of the highest pressure portion of the laminated medium. Similarly, the lowest pressure portion of the receptor medium may be located on a position equal to or different from that of the highest pressure portion of the laminated medium. For example, for both of the receptor portion and the laminator portion, the highest pressure portion is a portion of the medium at the load center A, and the lowest pressure portion is an end of the medium in the left-right direction which is separated farther from the load center A than another end of the medium in the left-right direction from the load center A. In these case, the CPU 51 can control the energy supplied to the thermal head 31 for the receptor medium, so that a print density can be ensured even for low pressure portion of the receptor medium, thereby preventing print blurring from occurring.

What is claimed is:

1. A printing apparatus comprising:

a thermal head including a plurality of heater elements arranged in line, the plurality of heater elements including a first heater element and a second heater element;

a platen member in confrontation with the thermal head, a sheet which is conveyed in a conveyance direction being nipped between the platen member and the thermal head;

an urging member configured to urge at least one of the thermal head and the platen member to approach each other to apply pressure to the sheet nipped between the thermal head and the platen member, the pressure varying in accordance with a position in a width direction crossing the conveyance direction, the sheet including a first area and a second area different from the first area, the first area receiving a first pressure from the urging member and the second area receiving a second pressure from the urging member, the first pressure being lower than the second pressure, the first area being located at a first position corresponding to the first heater element, the second area being located at a second position corresponding to the second heater element; and a processor configured to:

set energy to be supplied to the plurality of heater elements so that the first heater element receives energy higher than energy that the second heater element receives; and control the set energy to be supplied to the plurality of heating elements.

2. The printing apparatus according to claim 1, wherein the pressure at a position in the width direction is determined in accordance with a distance from a pressure center to the position, the pressure center being a center of pressure based on urging forces generated by the urging member.

3. The printing apparatus according to claim 2, wherein the processor is configured to set the energy to be supplied to each heater element on a basis of a function having a parameter indicating a distance from the pressure center to a position in the width direction corresponding to the each heater element.

4. The printing apparatus according to claim 3, wherein the processor is configured to set the energy to be supplied to each heater element on a basis of one of functions which is selected on a basis of a type of the sheet, each of the functions having a parameter indicating a distance from the pressure center to a position in the width direction corresponding to the each heater element.

5. The printing apparatus according to claim 1, wherein a distribution of the pressure in the width direction depends on a widthwise length of the sheet.

6. The printing apparatus according to claim 1, wherein a distribution of the pressure in the width direction depends on a position of the conveyed sheet relative to the thermal head in the width direction.

7. The printing apparatus according to claim 1, further comprising a storage storing a table correlating information about energy to be supplied to the plurality of heater elements with a widthwise length of the conveyed sheet, and a position of the conveyed sheet relative to the thermal head in the width direction, and, wherein the processor is configured to set the energy on a basis of the table.

8. The printing apparatus according to claim 1, wherein the thermal head has one end and another end in the width direction, wherein the urging member is closer to the one end than to the another end, wherein the sheet has one end and another end in the width direction, when the sheet is conveyed, the one end of the sheet being closer to the one end of the thermal head than to the another end of the thermal head, wherein the sheet includes a sensor mark closer to the one end thereof than to the another end thereof, the printing apparatus further comprising a sensor to detect the sensor mark, the sensor being closer to the one end of the thermal head than to the another end of the thermal head.

9. The printing apparatus according to claim 1, wherein one of a laminate type sheet and a receptor type sheet is used as the sheet, the laminate type sheet having a surface to be covered by a transparent base material after a print operation, the receptor type sheet having a surface to be uncovered after a print operation, wherein in a case where the laminate type sheet and the receptor type sheet have an equivalent widthwise length, the processor is configured to set energy to be supplied to the plurality of heater elements so that, for each heater element to which energy is to be supplied, the energy to be supplied to the each heater element for the receptor type sheet is larger than energy to be supplied to the each heater element for the laminate type sheet, wherein in a case where a pressure difference between a highest pressure and a lowest pressure is equivalent for both the laminae type sheet and the receptor type sheet, the processor is configured to set the energy so that a difference in energy for the receptor type sheet between energy supplied to a heater element corresponding to a first portion and energy supplied to a heater element corresponding to a second portion is larger than a difference in energy for the laminated type sheet between energy supplied to a heater element corresponding to a third portion and energy supplied to a heater element corresponding to a fourth portion, the highest pressure being a maximum pressure among pressures applied to the sheet from the urging member, and the lowest pressure being a minimum among pressures applied to the sheet from the urging member, the first portion being a portion of the receptor type sheet receiving the lowest pressure and the second portion being a portion of the receptor type sheet receiving the highest pressure, the third portion being a portion of the laminated type sheet receiving the lowest pressure and the fourth portion being a portion of the laminated type sheet receiving the highest pressure.

10. A printing apparatus comprising:

a thermal head including a plurality of heater elements arranged in line;

a platen member in confrontation with the thermal head, a sheet which is conveyed in a conveyance direction being nipped between the platen member and the thermal head;

an urging member configured to urge at least one of the thermal head and the platen member to approach each other to generate pressure to the sheet nipped between the thermal head and the platen member; and a processor configured to control energy to be supplied to the plurality of heater elements so that energy supplied to each heater element varies depending on a distance from a pressure center to the each heater element, the pressure center being a center of pressure based on urging forces generated by the urging member.

11. The printing apparatus according to claim 10, wherein the processor is configured further to receive width information on a widthwise length of the sheet, wherein the processor is configured to control the energy to be supplied to the plurality of heater elements on a basis of the width information.

12. The printing apparatus according to claim 10, wherein the pressure at a position in the width direction is determined in accordance with a distance from the pressure center to the position.

13. The printing apparatus according to claim 12, wherein the processor is configured to set the energy to be supplied to each heater element on a basis of a function having a parameter indicating a distance from the pressure center to a position in the width direction corresponding to the each heater element.

14. The printing apparatus according to claim 13, wherein the processor is configured to set the energy to be supplied to each heater element on a basis of one of functions which is selected on a basis of a type of the sheet, each of the functions having a parameter indicating a distance from the pressure center to a position in the width direction corresponding to the each heater element.

15. The printing apparatus according to claim 10, wherein a distribution of the pressure in the width direction depends on a widthwise length of the sheet.

16. The printing apparatus according to claim 10, wherein a distribution of the pressure in the width direction depends on a position of the conveyed sheet relative to the thermal head in the width direction.

17. The printing apparatus according to claim 10, further comprising a storage storing a table correlating information about energy to be supplied to the plurality of heater elements with a widthwise length of the conveyed sheet, and a position of the conveyed sheet relative to the thermal head in the width direction, and, wherein the processor is configured to set the energy on a basis of the table.

18. The printing apparatus according to claim 10, wherein the thermal head has one end and another end in the width direction, wherein the urging member is closer to the one end than to the another end, wherein the sheet has one end and another end in the width direction, when the sheet is conveyed, the one end of the sheet being closer to the one end of the thermal head than to the another end of the thermal head, wherein the sheet includes a sensor mark closer to the one end thereof than to the another end thereof, the printing apparatus further comprising a sensor to detect the sensor mark, the sensor being closer to the one end of the thermal head than to the another end of the thermal head.

19. The printing apparatus according to claim 10, wherein one of a laminate type sheet and a receptor type sheet is used as the sheet, the laminate type sheet having a surface to be covered by a transparent base material after a print operation, the receptor type sheet having a surface to be uncovered after a print operation, wherein in a case where the laminate type sheet and the receptor type sheet have an equivalent widthwise length, the processor is configured to set energy to be supplied to the plurality of heater elements so that, for each heater element to which energy is to be supplied, the energy to be supplied to the each heater element for the receptor type sheet is larger than energy to be supplied to the each heater element for the laminate type sheet, wherein in a case where a pressure difference between a highest pressure and a lowest pressure is equivalent for both the laminae type sheet and the receptor type sheet, the processor is configured to set the energy so that a difference in energy for the receptor type sheet between energy supplied to a heater element corresponding to a first portion and energy supplied to a heater element corresponding to a second portion is larger than a difference in energy for the laminated type sheet between energy supplied to a heater element corresponding to a third portion and energy supplied to a heater element corresponding to a fourth portion, the highest pressure being a maximum pressure among pressures applied to the sheet from the urging member, and the lowest pressure being a minimum among pressures applied to the sheet from the urging member, the first portion being a portion of the receptor type sheet receiving the lowest pressure and the second portion being a portion of the receptor type sheet receiving the highest pressure, the third portion being a portion of the laminated type sheet receiving the lowest pressure and the fourth portion being a portion of the laminated type sheet receiving the highest pressure.

* * * * *